United States Patent [19]

Schaefer

[11] Patent Number: 4,480,582

[45] Date of Patent: Nov. 6, 1984

[54] ADHESIVE APPLYING APPARATUS

[76] Inventor: Charles Schaefer, Captains Dr., Westbrook, Conn. 06498

[21] Appl. No.: 484,482

[22] Filed: Apr. 13, 1983

[51] Int. Cl.[3] ..... B05C 1/12; B05D 1/40

[52] U.S. Cl. ..... 118/245; 118/70; 118/104; 118/246; 118/249; 118/250; 118/262; 118/203; 101/425

[58] Field of Search ..... 118/245, 70, 203, 246, 118/249, 250, 247, 104; 100/174; 101/352, 425

[56] References Cited

U.S. PATENT DOCUMENTS

| | | | |
|---|---|---|---|
| 1,656,877 | 1/1928 | Wetmore | 118/250 |
| 2,665,662 | 1/1954 | Richmond et al. | 118/246 |
| 3,000,347 | 9/1961 | Schaefer | 118/245 |
| 3,962,025 | 6/1976 | Jacobson | 118/249 |
| 4,006,704 | 2/1977 | Perondi | 118/245 |
| 4,168,902 | 9/1979 | Golz | 118/245 |

*Primary Examiner*—Michael R. Lusignan
*Assistant Examiner*—Robert J. Steinberger, Jr.

[57] ABSTRACT

An improvement in the type of apparatus for applying adhesive to sheet materials wherein the sheet material is fed between a feed roller and an adhesive coated coating roller, and stripping elements thereafter strip the adhesive coated sheet material from the coating roller. The improvement comprises a main support mounted for rotation about the axis of the cleaning roller, the feed roller and the stripping elements being mounted on the main support for rotation therewith from an operating position to a cleaning position.

12 Claims, 5 Drawing Figures

ADHESIVE APPLYING APPARATUS

BACKGROUND OF THE INVENTION

This invention relates generally to machines used to apply various types of liquid adhesives to sheet materials such as paper, cloth, leather, cardboard, plastic, etc. The invention is particularly directed to improvements in such machines for facilitating access to and the cleaning of the various components of the machine which may become clogged with adhesive during operation.

Adhesive applying machines of the kind to which this invention relates, generally include a tank or reservoir to hold the adhesive, a coating roller, a system of transfer rollers for supplying a uniform coating of adhesive to the coating roller from the tank or reservoir, one or more feed rollers for feeding the sheet material into tangential contact with the coating roller whereby the adhesive is transferred to the sheet material, and stripping elements for stripping the adhesive coated sheet material from the surface of the coating roller to ensure that the sheet material will not stick to the surface of the coating roller and will be delivered to a conveyor belt or other means for transporting the coated sheet material away from the adhesive applying apparatus. During operation, sheet material to be coated with adhesive is fed into the machine where it is passed through a gap between at least one feed roller and the coating roller so as to transfer the adhesive to the side of the sheet material in contact with the coating roller.

In adhesive applying machines of this type, it is necessary, from time to time, to clean the feed rollers, the coating roller and the stripping elements in order to remove excess adhesive, pieces of sheet material or other foreign matter with which the machine becomes clogged. In the usual operating configuration, the feed rollers are located generally below the coating roller and the stripping elements are located generally behind the coating roller. In these positions they are inaccessible for cleaning purposes, so that a practical machine of the described character must have some means for affording ready access to the feed rollers and stripping elements.

In some designs of this type of machine, the coating roller is displaced to provide access to the feed rollers and stripping elements. However, due to the great weight of the coating roller this method has been generally found to be unsatisfactory. The mechanism for displacing the coating roller must have a great mechanical advantage, and consequently takes a great amount of time to operate.

Furthermore, for proper machine operation, the distance between the coating roller and the transfer roller which transfers adhesive to the coating roller must remain constant over the life of the machine. If the coating roller is displaced during cleaning, it is often difficult to return it to its proper location relative to the transfer roller, and as the cleaning mechanism for displacing the coating roller wears over time, the proper relationship between the transfer roller and the coating roller is often disturbed.

More recent designs such as that shown in U.S. Pat. No. 3,000,347 move the feed rollers and the stripping elements away from the coating roller to provide access for cleaning rather than move the coating roller. While this has the advantage of maintaining the proper relationship between the coating roller and the transfer roller, it has the disadvantage of disturbing the relationship between the coating roller and the feed rollers.

Furthermore, the design shown in U.S. Pat. No. 3,000,347 requires a complicated gearing arrangement to drive the feed rollers in the cleaning position as well as in the operating position. This provides a definite advantage during the cleaning operation. The present invention utilizes a much simpler gearing arrangement to achieve this desirable end result.

During operation, the stripping elements in this type of machine are in contact with the coating roller at a point downstream of the point where the sheet material contacts the coating roller. Regardless of design, this contact causes the stripping elements to accumulate adhesive. To avoid the accumulation of an excess amount of adhesive, it is well known that the contact portion of the stripping element in contact with the coating roller should be the lowest point on the stripping element. Thus, as the stripping element strips off adhesive, the adhesive tends to drip back to the contact point where it is carried away by the coating roller.

Previous designs have not maintained this relationship (i.e., maintained the contact portion of the stripping element below the remainder of the stripping element) as the stripping elements are moved into the cleaning position. Thus, in previous designs, as the stripping elements are moved into the cleaning position, adhesive on the contact end of the stripping elements has dripped back down the stripping elements contaminating the previously uncontaminated portions of the stripping elements just prior to the time when the cleaning operation begins. The present invention eliminates this problem by maintaining the contact portion of the contact end below the remaining portion of the contact end as the cleaning rollers and stripping elements are rotated into the cleaning position.

Additionally, the present invention allows the stripping elements to be easily removed for cleaning.

SUMMARY OF THE INVENTION

The present invention comprises an improvement in an apparatus for applying adhesive to sheet materials having a coating roller, means for applying adhesive to the coating roller, a feed roller to feed the sheet material into tangential contact with the coating roller thereby transferring the adhesive to the surface of the sheet material, and means for stripping the adhesive coated sheet material from the coating roller. The improvement comprises (a) a main support means mounted for rotation about the axis of the coating roller from a first operating position to a second cleaning position, (b) the feed roller being mounted on the main support means for movement therewith, and (c) the stripping means being mounted on the main support means for movement therewith, whereby the stripping means and the feed roller may be rotated around the axis of the coating roller as the main support means is rotated to provide access for cleaning.

A preferred embodiment of the present invention may have one or more of the following features.

The feed roller may be mounted on a feed roller mounting member which may be pivotally mounted on the main support means, and the apparatus may further include a means for adjusting the distance between the feed roller and the coating roller by pivoting the feed roller mounting member to various positions to accommodate different thicknesses of sheet material.

The feed roller ahd the coating roller may be geared together with gears having a depth of engagement greater than the range of adjustment of the distance between the coating roller and the feed roller so that the gears remain engaged as the distance between said rollers is adjusted and as the main support means is rotated from the operating position to the cleaning position.

The stripping means may be mounted on a stripper mounting member which may be rotatably mounted on the main support means, and the apparatus may be provided with a means for rotating the stripper mounting member so as to move the stripping means from its operating position to a cleaning position away from the coating roller. With this arrangement, the means for rotating the stripper mounting member preferably rotates said member so as to maintain the contact portion of the contact end of the stripping means below the remaining portion of the contact end as the stripping means is rotated out of contact with the coating roller and into the cleaning position.

The apparatus may also be provided with a means for removing the stripper mounting member from the main support means so that it may be cleaned.

DETAILED DESCRIPTION OF THE PREFERRED EMBODIMENT

Figure 1:
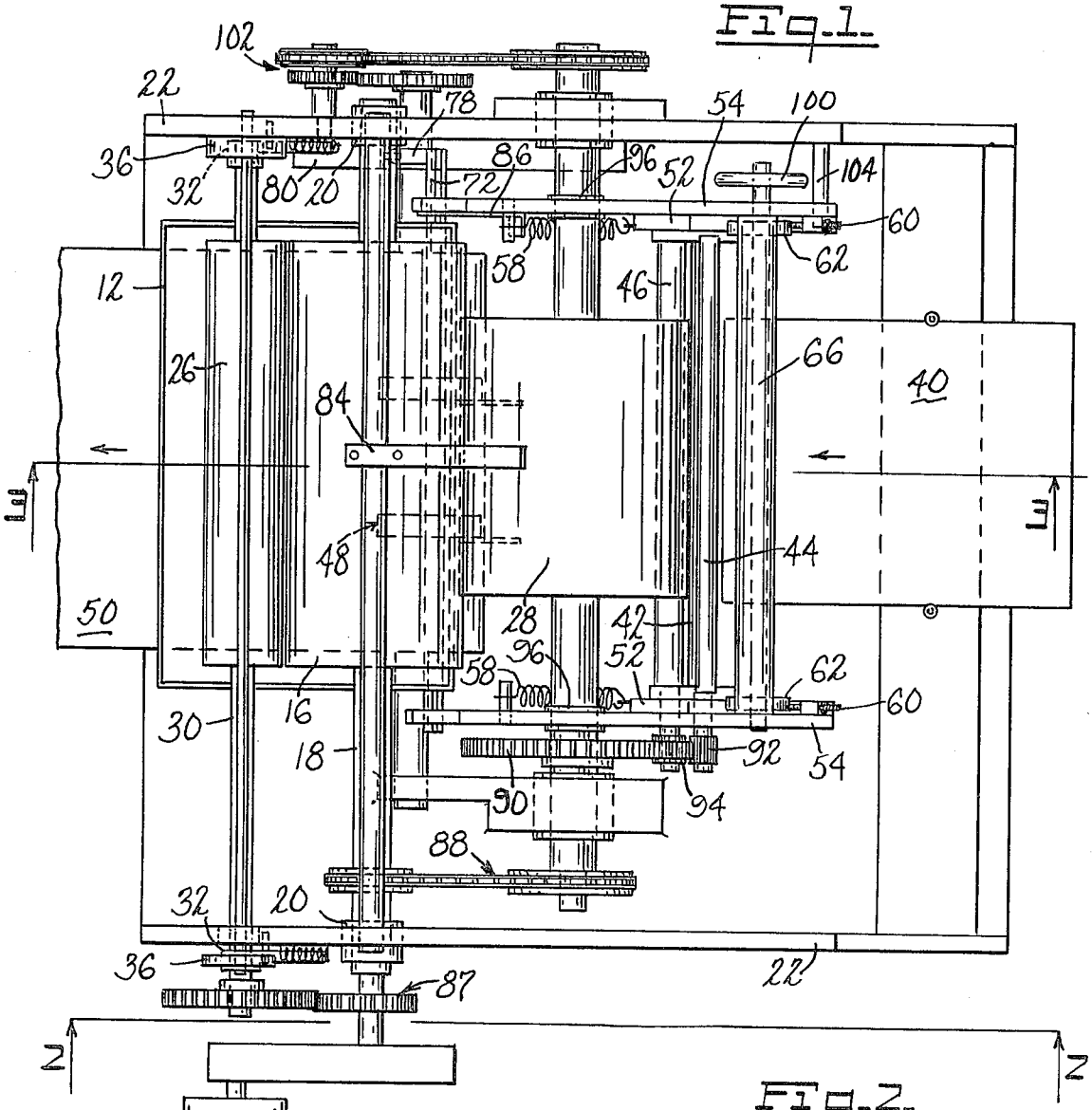
FIG. 1 is a top plan view of the preferred embodiment of the present invention with the apparatus in the operating position.
Figure 2:
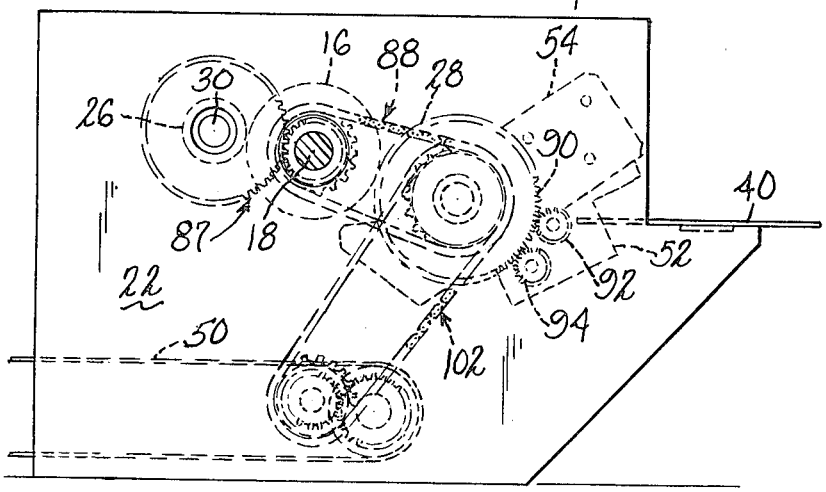
FIG. 2 is a side, partially in section, view taken along the line 2—2 shown in FIG. 1 with the apparatus in the operating position.
Figure 3:
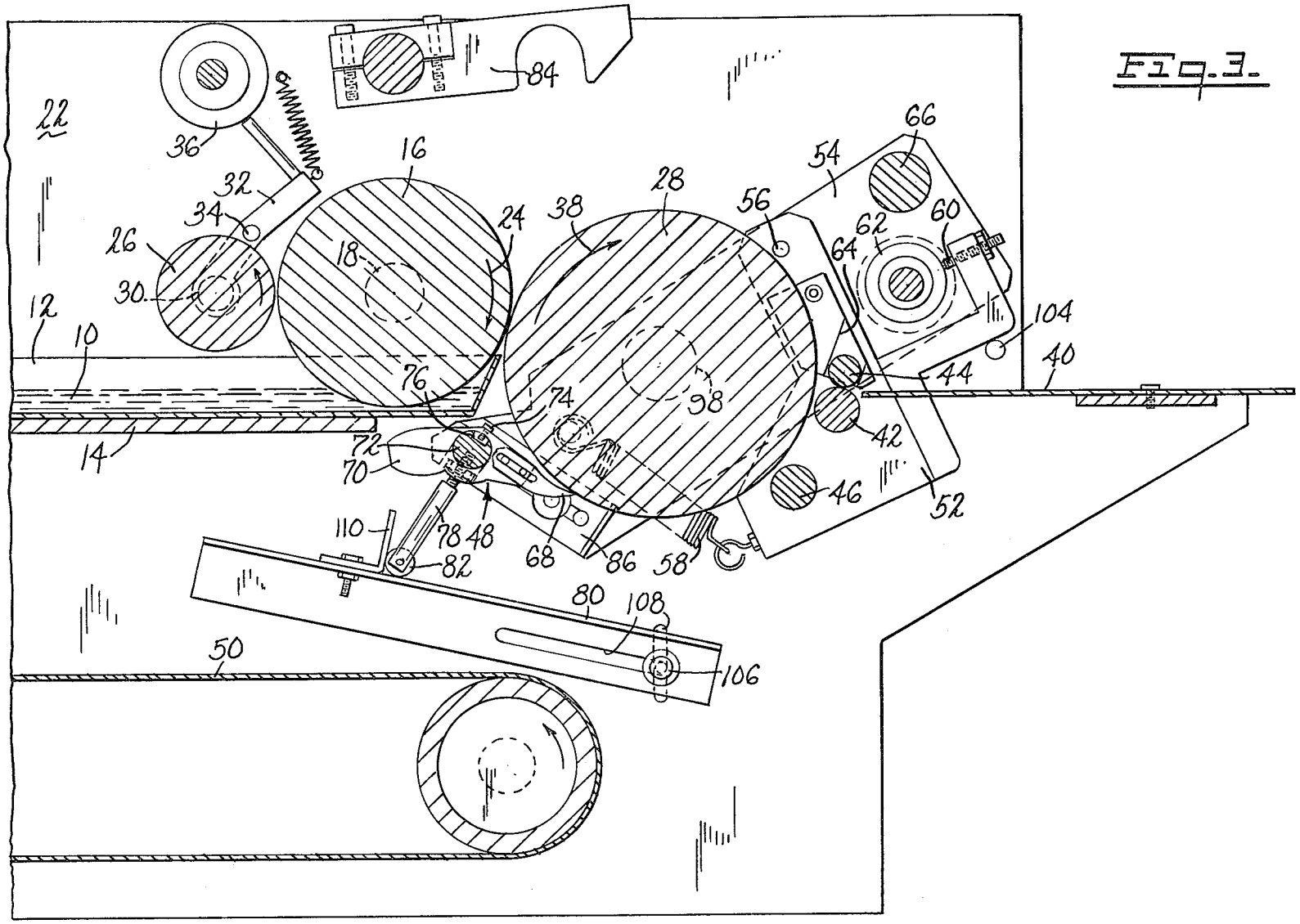
FIG. 3 is a sectional view taken along the line 3—3 shown in FIG. 1 with the apparatus in the operating position.

Referring generally to FIGS. 1, 2 and 3 and in detail to FIG. 3, the preferred embodiment of the invention can be seen in the operating position. A liquid adhesive 10 is contained in tank 12 supported on shelf 14. Adhesive is picked up from tank 12 by the pick up roller 16 rotating about shaft 18 journaled in bearings 20 mounted in apparatus side frames 22. The adhesive pickup roller 16 rotates in the direction shown by arrow 24.

The gap between ductor roller 26 and pickup roller 16 adjusts the quantity of adhesive carried by the pickup roller 16 to the coating roller 28.

Ductor roller 26 rotates about shaft 30 which is mounted in pivot arms 32. Pivot arms 32 may pivot about pivot point 34 to adjust the gap between ductor roller 26 and pickup roller 16 thereby adjusting the quantity of adhesive transferred to the coating roller.

The position of pivot arms 32 is controlled by an eccentric cam 36 which may be rotated to various positions to provide various gaps between ductor roller 26 and pickup roller 16 thereby controlling the flow of adhesive.

Coating roller 28 rotates in the direction shown by arrow 38. It may be seen that the surfaces of the pickup roller 16 and the coating roller 28 move in opposite directions at their closest point. The gap between these rollers is typically in the vicinity of 0.001 inches (25 microns) and this provides a wiping action which transfers the adhesive in a uniform layer to the coating roller 28.

Sheet material to be coated with adhesive is fed into the apparatus on feed plate 40 where it passes between the first feed roller 42 and the idler roller 44. The sheet material then passes between the first feed roller 42 and the coating roller 28, between the second feed roller 46 and the coating roller 28 to the stripping means shown generally at 48 where it is stripped from the coating roller and deposited on conveyor belt 50. Although two feed rollers are shown in the preferred embodiment, only one is required for proper operation.

Feed rollers 42 and 46 are journaled in bearings mounted on the feed roller mounting member 52. In the preferred embodiment feed roller mounting member 52 comprises a pair of vertical spaced apart plates pivotally mounted on a main support means 54. Feed roller mounting member 52 pivots about pivot point 56 on the main support means 54.

The pivotal mounting of the feed roller mounting member 52 allows the feed rollers 42 and 46 to be positioned at various distances from the coating roller 28 so as to accommodate varying thickness of sheet materials. The position of the feed rollers is controlled by the feed roller biasing means 58, which may be a spring as shown in FIG. 3, adjustable stop 60 and eccentric cam 62. Spring 58, mounted on the main support means 54 and connected to the feed roller mounting plate 52, urges the feed rollers 42 and 46 towards the coating roller by pivoting the feed roller mounting means 52 about pivot point 56. Stop 60 rides upon eccentric cam 62 which is rotatably mounted on the main support means 54.

Eccentric cam 62 may be rotated to various positions to adjust the gap between the feed rollers 42 and 46 and the coating roller 28. In the preferred embodiment, stop 60 is comprised of a threaded rod and a lock nut, as may be seen in FIG. 3, making the stop adjustable. Eccentric cam 62 may be held at any desired rotational position by means of a friction fitting, click stop mounting or by any other well known means. Although the preferred embodiment uses a pivotally mounted feed roller mounting member 52, the feed rollers could be directly mounted to the main support means 54 in other embodiments.

Idler roller 44 is captured in a slot 64 which enables it to ride up as the sheet material is fed between the idler roller 44 and the first feed roller 42.

The main support means 54 comprises two vertical spaced apart mounting plates coupled together by a rigid rod 66.

Stripping means 48 generally comprises a contact end 68 and a mass counterbalance end 70. Stripping means 48 is rotatably mounted on the stripper mounting member 72 which preferably comprises a shaft mounted on the main support means 54.

Rotation of the stripping means 48 about the stripper shaft 72 is limited by a projecting bolt 74 which projects into a longitudinal slot 76 in the stripper shaft 72. Mass counterbalance end 70 of the stripping means 48 is heavier than the contact end 68 and acts as a stripper biasing means to bias the contact end 68 of the stripping means 48 into contact with the coating roller 28 within the limited range of rotation allowed by the projecting bolt 74 and the longitudinal slot 76.

As can be seen in FIG. 3 only a small portion of the contact end 68 of the stripping means 48 is in contact with the coating roller 28. This small contact portion minimizes the quantity of adhesive which collects on the stripping means 48.

It will be noted that the portion of the contact end 68 in contact with the coating roller 28 is lower than the remaining portion of the contact end 68. This allows the adhesive stripped by the stripping means 48 to drip towards the contact portion thereby avoiding contamination by adhesive of the remaining portions of the stripping means 48. Adhesive on the contact end 68 drips toward the contact portion where it is swept away by the coating roller 28, and by this means, excess adhesive build-up on the stripping means 48 is avoided.

The stripper mounting member 72 is rotatably mounted on the main support means 54. A means for rotating the stripper mounting member is provided consisting of a toggle lever 78 and a guideway 80.

The toggle lever 78 is connected to the stripper shaft 72 and has a small wheel 82 mounted on its opposite end which rides upon the guideway 80.

FIGS. 1, 2 and 3 show the apparatus in the operating position with the feed rollers 42 and 46 mounted generally below the coating roller 28 and with the stripping means 48 located generally behind the coating roller 28. In these positions, the feed rollers and the stripping means are not easily accessible for cleaning. In the present invention, the main support means 54 is rotatably mounted so that it may be rotated about the axis of the coating roller 28. To rotate the apparatus into the cleaning position, rigid bar 66 may be rotated up and back toward latch 84 which may be hooked over rigid bar 66 to hold the apparatus in the cleaning position.

Figure 4:
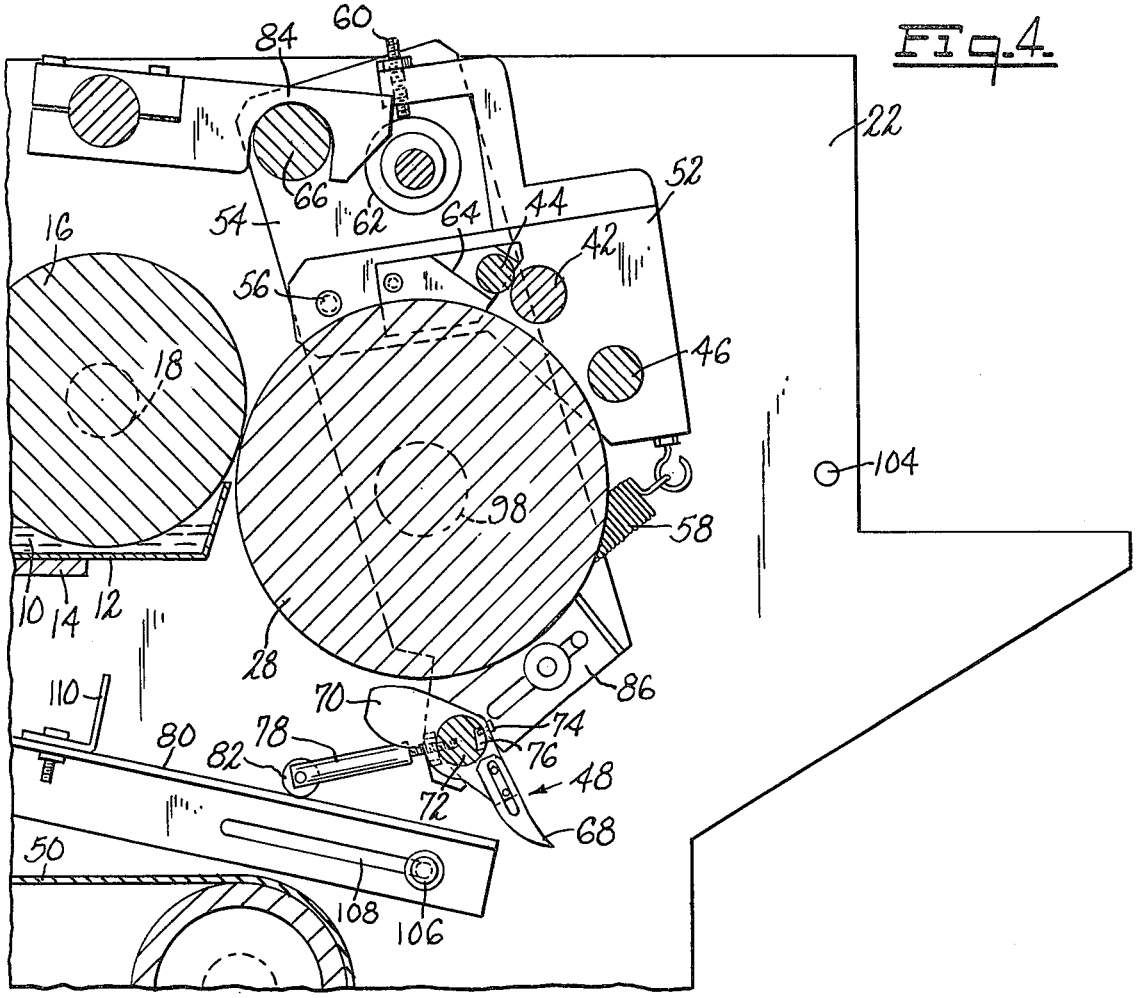
FIG. 4 is a partial side elevational sectional view along the same line of FIG. 3 with the apparatus in the cleaning position.

FIG. 4 shows the apparatus in the cleaning position. In this position the feed rollers 42 and 46 as well as the idler roller 44 and the stripping means 48 are easily accessible for cleaning.

As the main support means 54 is rotated from the operating position to the cleaning position, the relationship between the feed rollers 42 and 46 and the coating roller 28 is not disturbed. The angle at which guideway 80 is mounted controls the motion of toggle lever 78 and thereby rotates the stripper shaft 72. Because the rotation of the stripper means 48 about the stripper shaft 72 is limited by the width of the projecting bolt 74 and the longitudinal slot 76, the rotation of the stripper shaft swings the contact end 68 of the stripping means 48 away from the coating roller 28 into a position where it can be easily cleaned. It should be noted that the contact portion of the contact end 68 remains at all times below the remaining portion of the contact end 68. Thus, adhesive which has collected on the contact end remains at this lowest point and cannot drip onto the remaining portions of the stripping means 48 to contaminate the stripper shaft 72 or any other portion of the apparatus.

FIG. 4 clearly shows how the projection 74 limits the rotation of the stripper means 48 about the stripper shaft 72 by the restricted width of longitudinal slot 76.

Figure 5:
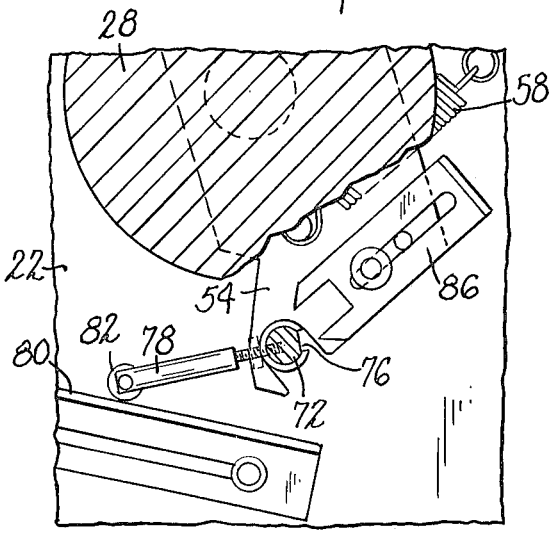
FIG. 5 is a partial sectional view along the same line of FIG. 4 with some elements partially or or completely removed for clarity, showing the sliding latch which allows removal of the stripping elements.

FIG. 5 shows the sliding latch mechanism 86 in detail. This latch allows the stripper shaft 72 and the stripping means 48, which is mounted thereon, to be removed for cleaning.

Referring to FIG. 1 again, the mounting and operation of the various elements can be understood more clearly. The apparatus contains two main side frames 22 which may be rigidly mounted to a base to provide support for the apparatus. A motor 85 drives the pickup roller 16 and the ductor roller 26 through a system of gears 87. A chain drive 88 drives the coating roller 28 from the shaft of the pickup roller 16. A gear 90 mounted on the shaft of the coating roller 28 drives two gears 92 and 94 mounted on the shafts of the feed rollers 42 and 46, respectively.

The main support means 54 is comprised of two vertical spaced apart mounting plates pivoted on bearings 96 mounted on the coating roller shaft 98.

In the design of this invention, feed roller gears 94 and 92 remain engaged with the coating roller gear 90 as the main support means 54 is rotated about the axis of the coating roller 28. This allows the feed rollers to be driven in the cleaning position as well as in the operating position which facilitates the cleaning operation.

One end of the stripper shaft 72 is mounted in a socket in one of the mounting plates of the main support means 54. The other end of the stripper shaft is captured in a sliding latch arrangement 86 seen more clearly in FIG. 5. Sliding the latch to the open position (as shown in FIG. 5) frees the latch end of the stripper shaft 72, allowing its other end to be removed from the socket in the main support means 54. This permits the stripper shaft 72 and the stripping means 48 to be readily removed for cleaning.

The feed roller mounting member 52 comprises two vertical parallel, spaced apart mounting plates pivotally mounted on the main support means. In the preferred embodiment, there are two eccentric cams 62 which may be rotated to the desired rotational position by means of hand wheel 100 to adjust the distance between the feed rollers 42 and 46 and the coating roller 28. Feed roller biasing means 58 comprises two springs shown in FIG. 1 which bias the feed rollers towards the coating roller. The feed rollers are prevented from contacting the coating roller 28 by two stops 60 which ride on the two eccentric cams 62. Although dual springs, cams and stops are used in the preferred embodiment, only one of each element is required. Gears 90, 92 and 94 have a depth of engagement which is greater than the range of adjustment of the distance between the coating roller and the feed rollers. This allows the distance between the coating roller and the feed rollers to be adjusted to provide for different thickness of sheet materials while maintaining the engagement of the feed roller gears 94 and 92 and the coating roller gear 90. A chain and gear drive system 102 drives the conveyor belt 50 in the appropriate direction.

Stop 104 is provided against which the apparatus is held by gravity in the operating position. A latch mechanism could also be used in different configurations of the invention to latch the invention in the operating position. The angle of guideway 80 is made adjustable by means of a bolt 106 sliding in slots 108. Wheel 82 on toggle lever 78 rests against a stop 110 in the operating position where it is securely positioned between the stop 110 and the guideway 80. Feed plate 40 is preferably made removable to allow the main support means 54 to rotate to the cleaning position.

Although an illustrative embodiment of the invention has been described in detail herein with reference to the accompanying drawings, it is to be understood that the invention is not limited to that precise embodiment and that various changes and modification may be effected therein without departing from the scope or spirit of the invention except as defined in the appended claims.

What I claim is:

1. In an apparatus for applying adhesive to sheet materials having a coating roller, means for applying adhesive to the coating roller, a feed roller to feed the sheet material into tangential contact with the coating roller thereby transferring the adhesive to the surface of the sheet material, and stripping means for stripping the adhesive coated sheet material from the coating roller, the improvement comprising:

a main support means mounted for rotation about the axis of the coating roller from a first operating position to a second cleaning position;

the feed roller being mounted on the main support means for movement therewith; and the stripping means being mounted on the main support means for movement therewith, whereby the stripping means and the feed roller may be rotated around the axis of the coating roller as the main support means is rotated to provide access for cleaning.

2. The apparatus of claim 1 further including:

a feed roller mounting member pivotally mounted on the main support means, the feed roller being mounted on the feed roller mounting member; and means for adjusting the distance between the feed roller and the coating roller by pivoting the feed roller mounting member to various positions to accommodate different thicknesses of sheet material.

3. The apparatus of claim 2 wherein the means for adjusting the distance between the feed roller and the coating roller comprises:

a feed roller biasing means for biasing the feed roller towards the coating roller;

an eccentric cam rotatably mounted on the main support means for rotation to different positions; and a stop mounted on the feed roller mounting member and held in contact with the eccentric cam by the feed roller biasing means whereby the distance from the feed roller to the contact roller may be adjusted as the eccentric cam is rotated to different positions.

4. The apparatus of claim 3 wherein the feed roller biasing means comprises a spring connected to the main support means and the feed roller mounting member.

5. The apparatus of claim 2 further including:

a feed roller gear connected to the feed roller;

a coating roller gear connected to the coating roller and engaged with the feed roller gear, the gears having teeth with a depth of engagement greater than the range of adjustment of the distance between the coating roller and the feed roller so that the gears remain engaged as the distance between said rollers is adjusted and as the main support means is rotated from the operating position to the cleaning positions.

6. The apparatus of claim 1 further including:

a stripper mounting member rotatably mounted on the main support means, the stripping means being mounted on the stripper mounting member; and means for rotating the stripper mounting member so as to move the stripping means from the operating position to a cleaning position away from the coating roller as the main support member is rotated from the operating position to the cleaning position.

7. The apparatus of claim 6 wherein:

the stripping means includes a contact end, a portion of which is in contact with the coating roller when the main support means is in the operating position;

the remaining portion of the contact end of the stripping means being entirely above the contact portion, whereby adhesive on the contact end tends to drip towards the contact portion and the coating roller; and the means for rotating the stripper mounting member rotates said member so as to maintain the contact portion of the contact end below the remaining portion of the contact end as the stripping means is rotated out of contact with the coating roller and into the cleaning position.

8. The apparatus of claim 6 wherein the means for rotating the stripper mounting member comprises:

a guideway; and a toggle lever with a first end attached to the stripper mounting member and a second end positioned to move along the guideway as the main support means is rotated, so as to rotate the stripper mounting member and thereby rotate the stripping means away from the coating roller as the main support means is rotated from the operating position to the cleaning position.

9. The apparatus of claim 6 wherein:

the stripping means is rotatably mounted on the stripper mounting member so that it may rotate within a limited range of rotation; and the stripping means further includes a stripper biasing means for biasing the stripping means into contact with the coating roller within the limited range of rotation when the stripping means is in the operating position.

10. The apparatus of claim 9 wherein:

the stripper mounting member comprises a shaft with a longitudinal slot contained therein;

the stripping means includes a projection into the longitudinal slot, the width of the slot and of the projection defining the limited range of rotation of the stripping means about the shaft; and the stripper biasing means comprises a mass, counterbalancing the stripping means about the shaft so as to bias the stripping means into contact with the coating roller when the main support means is in the operating position.

11. The apparatus of claim 10 wherein:

the main support member comprises two parallel spaced apart mounting plates; and one end of the stripper shaft is captured within a socket in one mounting plate, and the other end is captured within a latch means in the other mounting plate so that the stripping means and the stripper shaft may be removed for cleaning when the latch means is unlatched.

12. The apparatus of claim 1 wherein:

the stripper mounting member is removably mounted on the main support means to permit removal for cleaning.

* * * * *